US007617786B1

(12) United States Patent
Tseng

(10) Patent No.: US 7,617,786 B1
(45) Date of Patent: Nov. 17, 2009

(54) PRESSURE ADJUSTMENT STRUCTURE FOR A PRESSER FOOT OF A SEWING MACHINE

(76) Inventor: Hsien-Chang Tseng, 1F, No. 11, Lane 125, Sec. 1, Kuo Kuang Road, Ta-Li City, Taichung Hsien, 412 (TW)

( * ) Notice: Subject to any disclaimer, the term of this patent is extended or adjusted under 35 U.S.C. 154(b) by 0 days.

(21) Appl. No.: 12/118,732

(22) Filed: May 11, 2008

(51) Int. Cl.
*D05B 29/02* (2006.01)
*D05B 29/00* (2006.01)

(52) U.S. Cl. ..... 112/237

(58) Field of Classification Search ..... 112/235–240
See application file for complete search history.

(56) References Cited

U.S. PATENT DOCUMENTS 3,055,326 A * 9/1962 Greulich ..... 112/235
3,303,804 A * 2/1967 Lesort ..... 112/235
3,793,969 A * 2/1974 Adams ..... 112/235
4,342,272 A * 8/1982 Transue et al. ..... 112/237
4,660,481 A * 4/1987 Spickermann ..... 112/235
6,520,101 B2 * 2/2003 Sano et al. ..... 112/237
7,316,191 B2 * 1/2008 Shomura et al. ..... 112/235

* cited by examiner

*Primary Examiner*—Ismael Izaguirre
(74) *Attorney, Agent, or Firm*—Banger Shia

(57) ABSTRACT

A pressure adjustment structure for a presser foot of a sewing machine, wherein one end of a horizontal arm of the sewing machine is disposed with a presser bar of the presser foot, and an elastic member is mounted on the presser bar. The end of the horizontal arm is provided with a main supporting frame, so that the pressing member slides on the main supporting frame with a pressing body and a guiding member, and one end of the pressing member presses an elastic member. In addition, the pressing body extends towards and is driven by an adjustment element of the main supporting frame, so that the pressing member driven by the pressing body slides on the main supporting frame to press the elastic member so as to provide different pressure. A second supporting frame is disposed on the main supporting frame to connect with the horizontal arm.

8 Claims, 5 Drawing Sheets

PRESSURE ADJUSTMENT STRUCTURE FOR A PRESSER FOOT OF A SEWING MACHINE

BACKGROUND OF THE INVENTION

1. Field of the Invention

The present invention relates to a pressure adjustment structure for a presser foot of a sewing machine, and more particularly to a sewing machine provided with a pressure adjustment structure for adjusting an elastic pressure of a presser bar. Two supporting frames are connected with a horizontal arm to strengthen the whole structure of the sewing machine.

2. Description of the Prior Art

A conventional pressure adjustment structure for a presser foot of a sewing machine is such a structure that a presser bar connected with a presser foot is provided with an elastic structure, and the elastic structure is such that a cam-shaped adjustment element is pushing against a connecting bar. The structure of the connecting bar is complex, as shown in FIG. 5, wherein a top of the presser foot 90 is provided with a presser bar 91, an elastic member 92 is mounted on the presser bar 91, a top of the elastic member 92 is pressed by a gasket 93, and the gasket 93 is pressed and driven by one end of the connecting bar 94 which is made by a folded plate-shaped member. The middle part of the connecting bar 94 is pivotally connected to a pivot shaft 95, and the pivot shaft 95 is pivotally connected to one end of a horizontal arm of the sewing machine. The other end of the connecting bar 94 is pushed against by a cam portion of an adjustment element 96 which is pivotally disposed on one end of the horizontal arm. By rotation of the adjustment element 96, the connecting bar 94 rotate an angle around the pivot shaft 95, and the end of the connecting bar 94 pressed against the gasket 93 and one end of the elastic member 92 is caused to move downward to compress the elastic member 92, thus producing a prestress. However, such a structure still has following disadvantages:

1. The arrangement of the connecting bar 94 and the pivot shaft 95 is highly complex, and its stability is limited, because the connecting bar 94 is made by a folded plate-shaped member, the folding process carried on the connecting bar 94 is difficult, and the connecting bar 94 must cooperate the pivot shaft 95 to be positioned, so the assembling of the present invention is inconvenient, and the stability of the connecting bar 94 and the pivot shaft 95 is limited.

2. The indirect pressure is difficult to control: the connecting bar 94 rotates around the pivot shaft 95 to press the gasket 93, it is difficult to control the pressure, and the pressure is not stable due to a deficiency of the rotation of the connecting bar 94.

3. The strength of the whole structure is low: the adjustment element 96 is pivotally connected with a plate-shaped supporting frame at one end of the horizontal arm only by nuts being inserted through holes located around the supporting frame, and the connecting force is limited. Pressures are always produced in different directions during adjusting the adjustment element 96, thus causing a distortion of the supporting frame and a limited strength of the structure. The position of the adjustment element 96 is also affected, so that a pressure of the elastic member 92 will not be adjusted exactly.

The present invention has arisen to mitigate and/or obviate the afore-described disadvantages.

SUMMARY OF THE INVENTION

The primary objective of the present invention is to provide a pressure adjustment structure for a presser foot for a sewing machine, wherein a pressing member is slidably disposed on a main supporting frame, and the main supporting frame is mounted on one end of a horizontal arm. The pressing member is provided with a pressing portion and a pressing body, which extend towards an elastic member of a presser bar of the presser foot and an adjustment element pivotally disposed on the main supporting frame, so that the pressing member can be driven by the adjustment element directly to press the elastic member so as to adjust an elastic prestress of the elastic member.

Another objective of the present invention is to provide a pressure adjustment structure for a presser foot for a sewing machine, wherein the main supporting frame is connected with one end of the horizontal arm and a second supporting frame in the vertical direction, and one end of the second supporting frame is mounted to the vertical side of the horizontal arm, so that the main supporting frame will be supported by supporting forces from more than two different directions to strength the partial structure.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
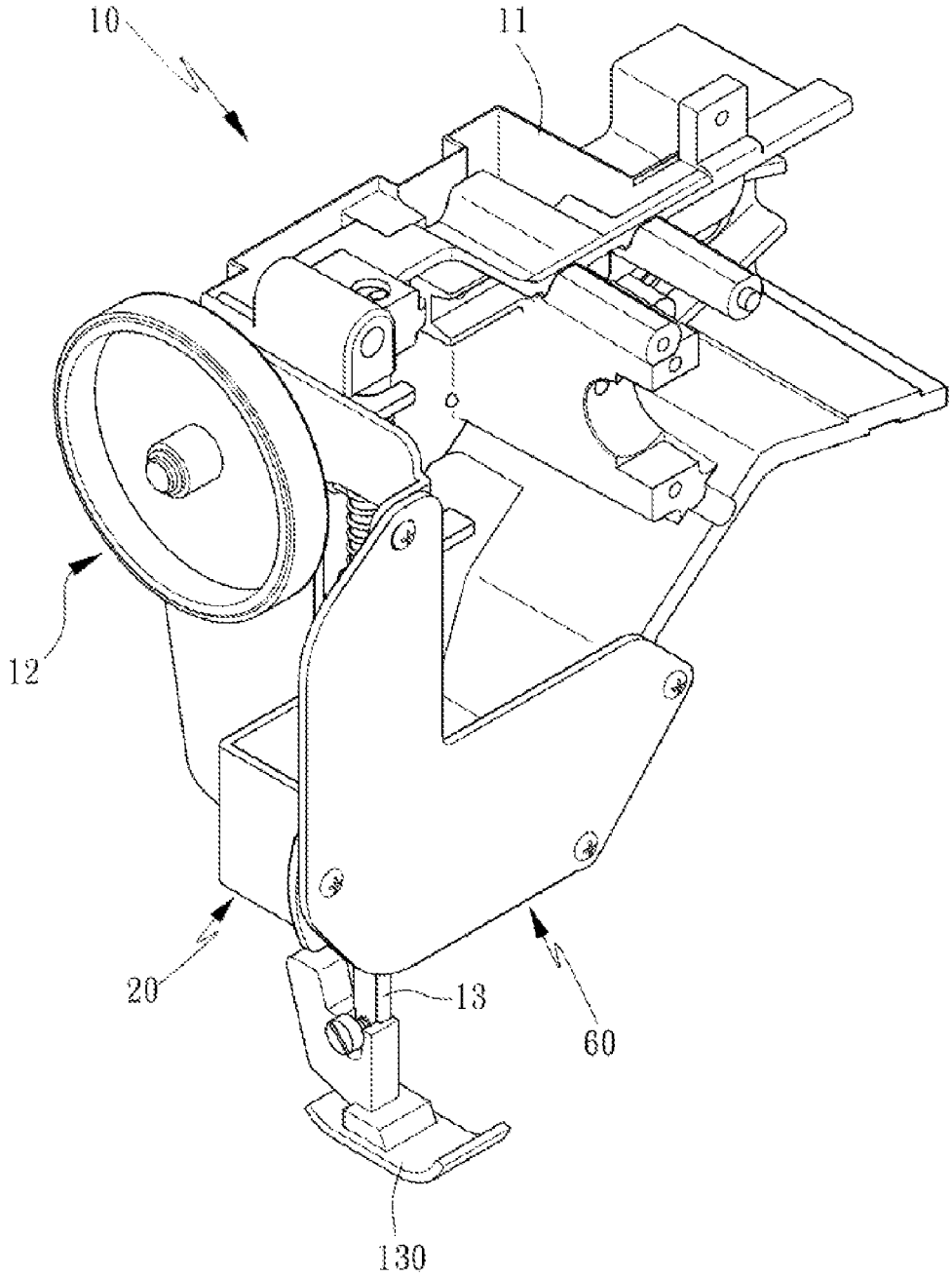
FIG. 1 is an assembly perspective view of a sewing machine in accordance with present invention.
Figure 2:
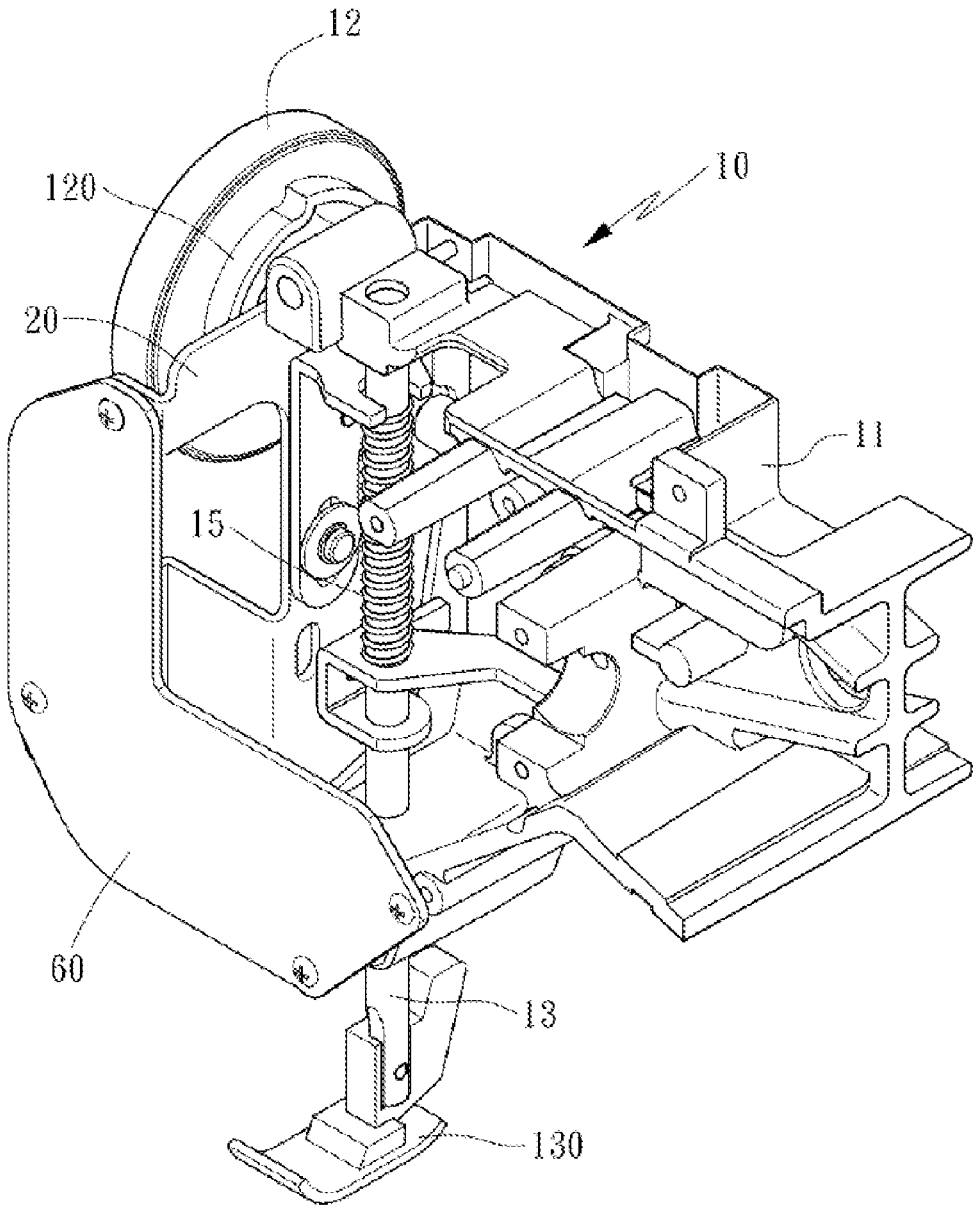
FIG. 2 is a perspective view of the sewing machine in accordance with the present invention.
Figure 3:
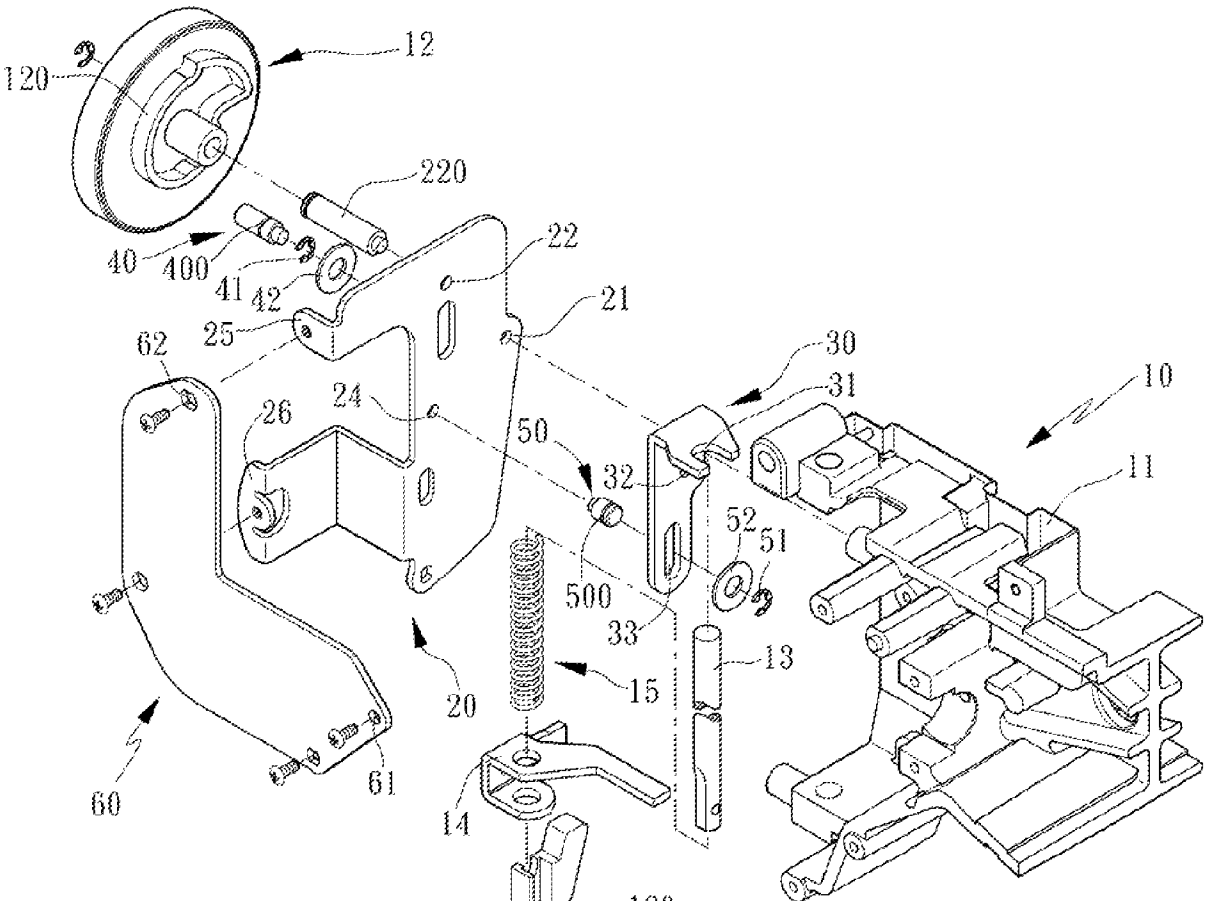
FIG. 3 is an exploded view of the sewing machine in accordance with the present invention.

Referring to FIGS. 1, 2 and 3, a sewing machine 10 in accordance with the present invention is provided with a horizontal arm 11, a housing is mounted on the horizontal arm 11, a free end of the horizontal arm 11 is disposed with an adjustment element 12, and one side of the adjustment element 12 facing the horizontal arm 11 is disposed with a cam-shaped adjustment portion 120 for adjusting the elastic force of a spring stopper 14 and an elastic member 15 which are mounted on a presser bar 13. A presser foot 130 is disposed at the bottom of the presser bar 13, the main characteristic of the present invention is described as follows:

One end of the horizontal arm 11 is disposed with a plate-shaped main supporting frame 20, a pressing member 30 is slidably disposed on the main supporting frame 20, one end of the pressing member 30 is provided with a pressing body 40 extending towards the adjustment portion 120 of the adjustment element 12, and the other end of the pressing member 30 extends towards the elastic member 15. A guiding member 50 and its cooperative structure are disposed between the pressing member 30 and the main supporting frame 20, so that the pressing member 30 can slide on the main supporting frame 20 smoothly, and the adjustment element 12 rotates to drive the pressing member 30 to press the elastic member 15 so as to control the prestress of the elastic member 15. The main supporting frame 20 is additionally provided at its one end with a second supporting frame 60 in the vertical direction thereof to stabilize the main supporting frame 20 and to strengthen the structure.

One side of the main supporting frame 20 facing the horizontal arm 11 is defined with two or three through positioning holes 21 for insertion of bolts, so that the main supporting frame 20 can be mounted to the end of the horizontal arm 11. The main supporting frame 20 opposite the center of the adjustment element 12 is defined with a pivot hole 22 for fixing a pivot shaft 220, a free end of the pivot shaft 220 is inserted through the center of the adjustment element 12, and then the adjustment element 12 is positioned by a C-buckle. The main supporting frame 20 is defined with a guiding portion 23 in the form of an elongated ellipse-shaped hole which is parallel with the presser bar 13 adjacent to the pivot hole 22 and is provided for insertion of the pressing body 40. The main supporting frame 20 is additionally defined with a circular through fixing hole 24 for fixing the guiding member 50 adjacent to the guiding portion 23, one end of the main supporting frame 20 away from the positioning holes 21 is vertically folded to form two second fixing portions 25 and 26 which are disposed with through holes for fixing the second supporting frame 60.

The pressing member 30 is inverse L-shaped and is made by a folded plate-shaped member. A pressing portion 31 having a half-moon-shaped opening extends from one end of the pressing member 30 towards the elastic member 15, and is abutted against the presser bar 13 to press a top of the elastic member 15, the other end of the pressing member 30 is parallel with and abutted against the main supporting frame 20. A circular fixing hole 32 is defined in the pressing member 30 for fixing one end of the pressing body 40, and the other end of the pressing body 40 is inserted through the guiding portion 23 and extends towards and contacts the adjustment portion 120 of the adjustment element 12. Thus, the pressing body 40 is pressed and driven by the adjustment element 12, the pressing member 30 is defined with a long guiding portion 33 which is parallel with the presser bar 13, and the guiding portion 30 is provided for insertion of the guiding member 50.

The pressing body 40 is cylinder-shaped, the pressing body 40 has one end disposed in the fixing hole 32 of the pressing member 30 and is defined with an annular stopping-groove 400 at the portion thereof where the pressing body 40 is inserted through the guiding portion 23 for engaging with a restricting member 41 in the form of a C-buckle, and a gasket 42 is disposed between the restricting member 41 and the guiding portion 23 to clamp the main supporting frame 20.

In addition, the guiding member 50 is cylinder-shaped, the guiding member 50 has one end disposed in the main supporting frame 20 and is defined with an annular stopping-groove 400 at the portion thereof where the guiding member 50 is inserted through the guiding portion 33 for engaging with a restricting member 51 in the form of a C-buckle, and a gasket 52 is disposed between the restricting member 51 and the guiding portion 33 to clamp the pressing member 30.

Figure 4:
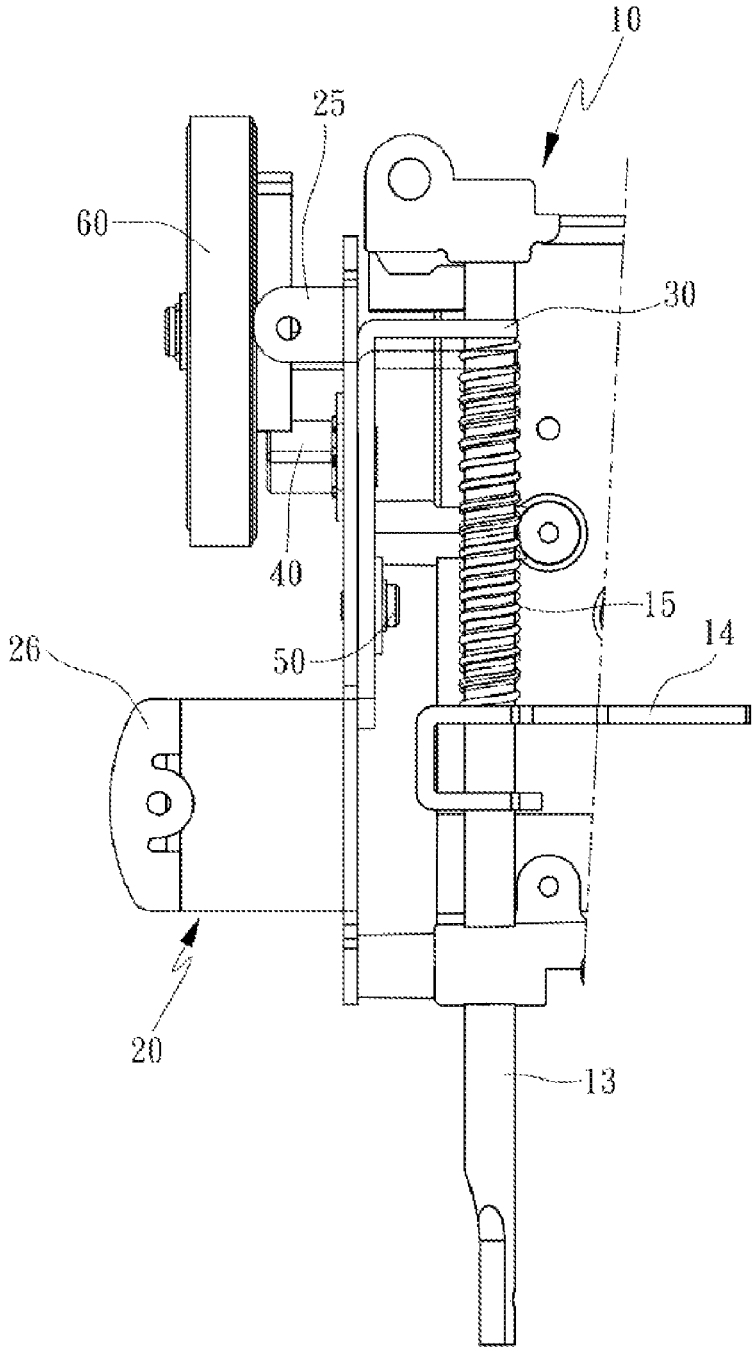
FIG. 4 is an assembly view of the sewing machine in accordance with the present invention.
Figure 5:
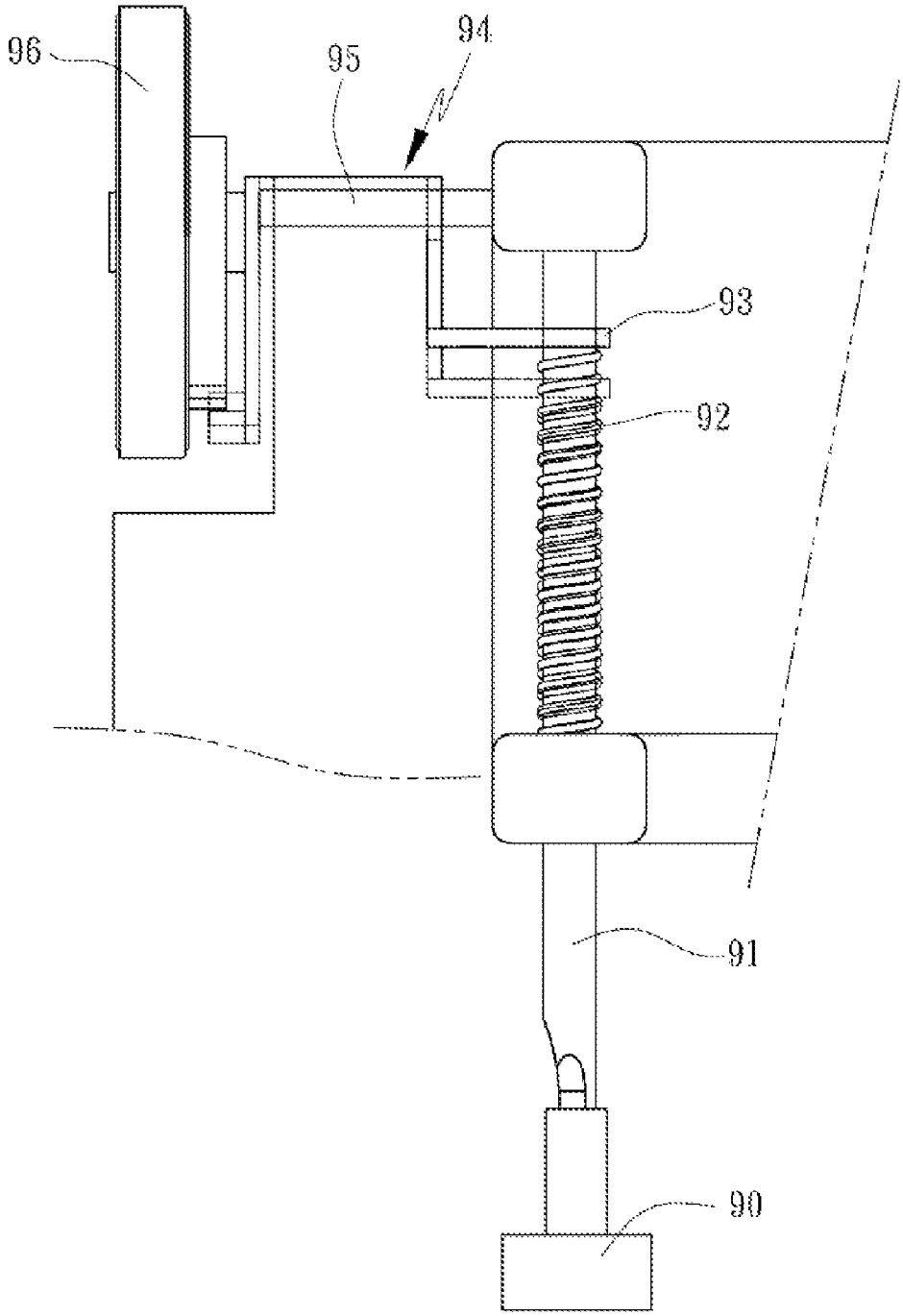
FIG. 5 is a view of a conventional sewing machine.

Referring to FIG. 4, when the adjustment element 12 rotates, the adjustment portion 120 of the adjustment element 12 presses the pressing body 40 of the pressing member 30 to enable the pressing body 40 to slide on the main supporting frame 20 at different heights. With cooperation of the restricting members 41, 51 of the pressing body 40 and the guiding member 50 and the gaskets 42, 52, the pressing member 30 can slide on the main supporting frame 20 stably to press the elastic member 15 directly.

Furthermore, the second supporting frame 60 is plate-shaped, the second supporting frame 60 is disposed at one end thereof with a plurality of fixing portions 61 for fixing the front surface of the horizontal arm 11, and is provided with main fixing portions 62 in the form of holes at the portion thereof for fixing the second fixing portions 25 and 26 of the main supporting frame 20, so that the main supporting frame 20, the second supporting frame 60 and the horizontal arm 11 are fixed together by bolts and nuts.

The following function can be achieved by the abovementioned structure:

1. The pressure of the elastic member 15 can be adjusted directly: since the pressure is transferred to elastic member 15 directly from the adjustment element 12 by the pressing body 40 and the pressing portion 31, and the pressing member 30 moves in parallel with the presser bar 13, so that the pressure can be transferred directly and stably.

2. The structure of the present invention is simple: the pressing member 30 and its cooperative structures are simple and stable, and such structure of the present invention can be acquired with less assembling processes and members, so that the cost can be reduced.

3. The structure of the present invention is strengthened: the vertical second supporting frame 60 enables the main supporting frame 20 to be fixed at different sides, so that the main supporting frame 20 can be supported by supporting forces from more than two different directions. Hence, the structure of the main supporting frame 20 is stronger and stable.

While we have shown and described various embodiments in accordance with the present invention, it is clear to those skilled in the art that further embodiments may be made without departing from the scope of the present invention.

What is claimed is:

1. A pressure adjustment structure for a presser foot of a sewing machine, comprising:

a sewing machine being provided with a horizontal arm, a free end of the horizontal arm being disposed with an adjustment element and a presser bar, an elastic member being mounted on the presser bar, and a presser foot being pivotally disposed at one end of the presser bar; and one end of the horizontal arm being disposed with a main supporting frame, a pressing member being slideably disposed on the main supporting frame and provided with a pressing body which being in contact with the adjustment element, and the pressing member is driven to press the elastic member by the adjustment element;

wherein the pressing body has one end fixed in the pressing member and is defined with an annular stopping-groove at the other end thereof for engaging with a restricting member which cooperates with a gasket to clamp the main supporting frame.

2. The pressure adjustment structure for a presser foot of a sewing machine as claimed in claim 1, wherein a pressing portion extends from one end of the pressing member towards the elastic member, the other end of the pressing member is parallel with and abutted against the main supporting frame, a fixing hole is defined in the pressing member for fixing the pressing body, and a guiding portion is defined in the pressing member.

3. The pressure adjustment structure for a presser foot of a sewing machine as claimed in claim 1, wherein one end of the main supporting frame is provided with a second supporting frame, the second supporting frame is disposed at one end thereof with a plurality of fixing portions for fixing a front surface of the horizontal arm, and is provided with main fixing portions at the portion thereof for fixing second fixing portions of the main supporting frame, so that the main supporting frame, the second supporting frame and the horizontal arm are fixed together by bolts;

one end of the main supporting frame is vertically folded to form a plurality of second fixing portions for fixing the second supporting frame.

4. A pressure adjustment structure for a presser foot of a sewing machine, comprising:

a sewing machine being provided with a horizontal arm, a free end of the horizontal arm being disposed with an adjustment element and a presser bar, an elastic member being mounted on the presser bar, and a presser foot being pivotally disposed at one end of the presser bar; and one end of the horizontal arm being disposed with a main supporting frame, a pressing member being slideably disposed on the main supporting frame and provided with a pressing body which being in contact with the adjustment element, and the pressing member is driven to press the elastic member by the adjustment element;

wherein the guiding member has one end disposed in the main supporting frame, and the other end of the guiding member inserted through the pressing member is defined with an annular stopping-groove for engaging with a restricting member which cooperates with a gasket to clamp the pressing member;

the main supporting frame is defined with a guiding portion in which the pressing body is to be slideably received, the pressing member is defined with a guiding portion in which the guiding member is to be sideably received.

5. The pressure adjustment structure for a presser foot of a sewing machine as claimed in claim 4, wherein a pressing portion extends from one end of the pressing member towards the elastic member, the other end of the pressing member is parallel with and abutted against the main supporting frame, a fixing hole is defined in the pressing member for fixing the pressing body, and the guiding portion is defined in the pressing member.

6. The pressure adjustment structure for a presser foot of a sewing machine as claimed in claim 4, wherein one end of the main supporting frame is provided with a second supporting frame, the second supporting frame is disposed at one end thereof with a plurality of fixing portions for fixing a front surface of the horizontal arm, and is provided with main fixing portions at the portion thereof for fixing second fixing portions of the main supporting frame, so that the main supporting frame, the second supporting frame and the horizontal arm are fixed together by bolts.

7. The pressure adjustment structure for a presser foot of a sewing machine as claimed in claim 6, wherein the main supporting frame is provided with a plurality of second fixing portions for fixing the second supporting frame.

8. A pressure adjustment structure for a presser foot of a sewing machine, comprising:

a sewing machine being provided with a horizontal arm, a free end of the horizontal arm being disposed with an adjustment element and a presser bar, an elastic member being mounted on the presser bar, and a presser foot being disposed at one end of the presser bar;

one end of the horizontal arm being disposed with a main supporting frame, the main supporting frame facing the horizontal arm being defined with a plurality of positioning holes, one end of the main supporting frame being vertically folded to form second fixing portions for fixing a second supporting frame;

the second supporting frame being disposed at one end thereof with a plurality of fixing portions for fixing a front surface of the horizontal arm, and being provided with main fixing portions at the portion thereof for fixing second fixing portions of the main supporting frame; and the main supporting frame, the second supporting frame and the horizontal arm being fixed together by bolts in such a manner that the main supporting frame is connected with the one end of the horizontal arm and the second supporting frame in a vertical direction, and one end of the second supporting frame is mounted to a vertical side of the horizontal arm.

* * * * *